United States Patent [19]

Wikner

[11] Patent Number: 4,976,434

[45] Date of Patent: Dec. 11, 1990

[54] TABLE GAME

[75] Inventor: Erland Wikner, Tranås, Sweden

[73] Assignee: Stiga Aktiebolag, Tranas, Sweden

[21] Appl. No.: 195,832

[22] Filed: May 19, 1988

[51] Int. Cl.[5] ..... A63F 7/06

[52] U.S. Cl. ..... 273/85 B; 273/85 F; 273/118 A; 273/119 A; 273/129 W; 273/89

[58] Field of Search ..... 273/85 R–85 F, 273/85 G, 88, 89, 90, 118 A, 119 A, 123 A, 126 A, 129 S, 129 T, 129 W, 86 B, 237

[56] References Cited

U.S. PATENT DOCUMENTS

| | | | |
|---|---|---|---|
| 2,470,159 | 5/1949 | Geary | 273/88 |
| 2,716,028 | 8/1955 | Yaeger | 273/85 B |
| 3,811,674 | 5/1974 | Trbovich et al. | 273/85 E |
| 3,912,269 | 10/1975 | Barlow | 273/85 B |
| 3,937,469 | 3/1976 | Cohen | 273/85 F |
| 4,033,584 | 7/1977 | Smith | 273/85 A |
| 4,146,224 | 3/1979 | Deutsch | 273/85 F |
| 4,192,508 | 3/1980 | Livick | 273/118 A |
| 4,256,307 | 3/1981 | Brooks | 273/118 A |
| 4,474,375 | 10/1984 | Stockdale | 273/85 B |

FOREIGN PATENT DOCUMENTS

| | | | |
|---|---|---|---|
| 1092354 | 11/1960 | Fed. Rep. of Germany | 273/89 |
| 2032670 | 1/1972 | Fed. Rep. of Germany | 273/85 B |
| 2492266 | 4/1982 | France | 273/118 A |
| 642845 | 7/1962 | Italy | 273/85 B |
| 567919 | 3/1945 | United Kingdom | 273/85 A |

*Primary Examiner*—Edward M. Coven
*Assistant Examiner*—Sebastiano Passaniti
*Attorney, Agent, or Firm*—Beveridge, DeGrandi & Weilacher

[57] ABSTRACT

The invention provides a new table game of the baseball type. The table game includes a number of player figures mechanically rotatably arranged on a playing surface for catching and forwarding a ball to base areas and also a player figure depicitng a batsman being able to strike the ball. The table game also includes manually operated switch or push button devices intended to be repeatedly manipulated for simulating one or more offensive players running between the bases and sensor devices being biasable by the ball. There is also an electronic computer system connecting the push buttons and the sensor devices with a number of indicating means indicating hit outs occuring when the ball is forwarded to any of the base areas and any offensive player simulated by repeated pressing of a push button is outside the base areas. The computer system being fed impulses both from the sensor devices, and the push buttons and having a presetable program determining the activation of the indicating means and any recording means.

6 Claims, 5 Drawing Sheets

FIG. 3
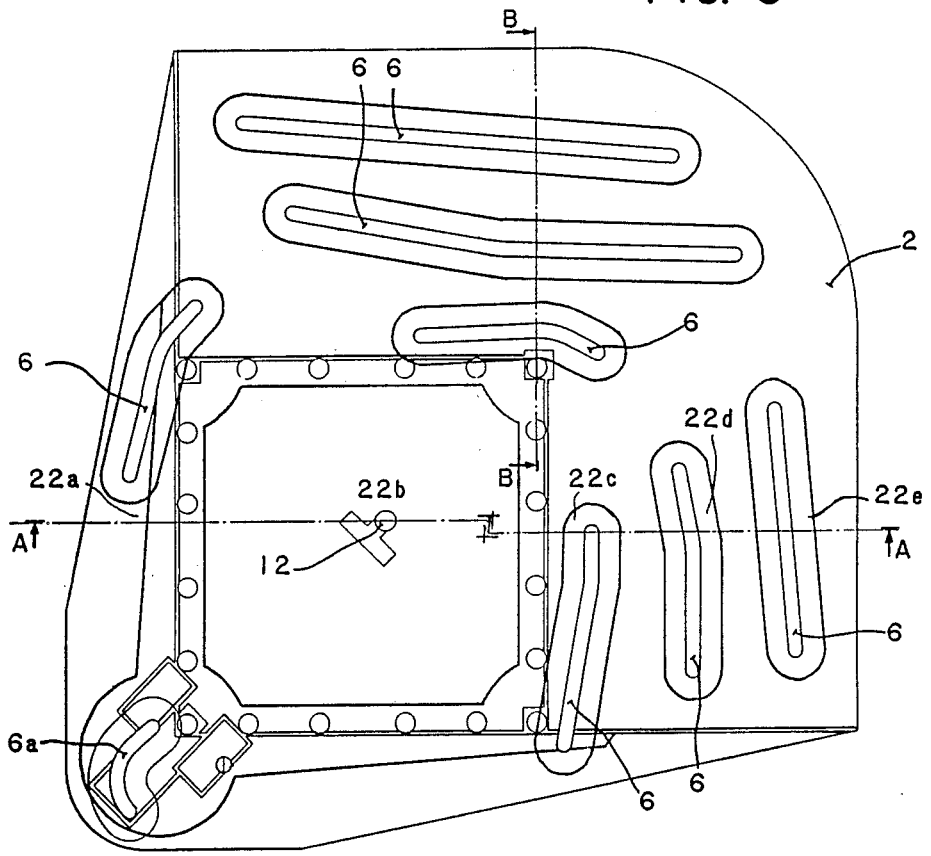
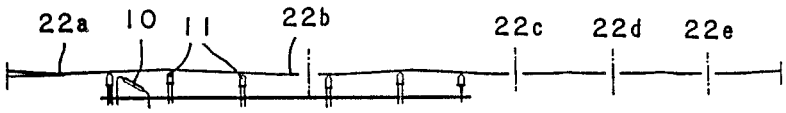
FIG. 4
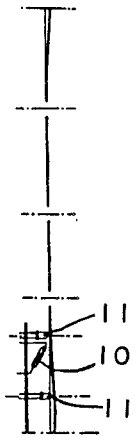
FIG. 5

TABLE GAME

This invention relates to a table game intended to imitate or depict baseball.

Known are a number of types of table games, e.g. football games and ice hockey games, wherein player figures are rotatably mounted on a sledge or carrier movable along a slot in a board or the like depicting a playing field. Control rods for moving the sledge and rotating the figure are arranged below the board. Known are also player figures having a movable leg in order to be able to kick a ball or like projectile towards a goal area. Such figures are normally carried by a swingable rod above the playing field board, and the operator's end of the rod is equipped with a trigger means for controlling the kicking leg.

Further there are known a number of simulated games for different types of sport using a playing field and a ball or the like movable over such field and having means for, biassing sensing devices arranged in or below the field surface.

The known table games are generally intended to simulate types of sport activities including a few parts within a non complicated activity pattern, e.g. moving the player along its slot, turning the same and hitting the ball or the like.

The object of this invention is to create a new type of table game, primarily adapted to simulate baseball, rounders and the like wherein the course of events consists of a wide number of activities and wherein the persons operating the table game have to operate not only mechanical devices in order to propel a ball over the playing field but also have to operate means biassing electronic devices simulating the players running towards the bases of the field and wherein there even is created a co-operation between the mechanical devices and the electronical system making it possible to simulate hit outs and the like situations.

Figure 1:
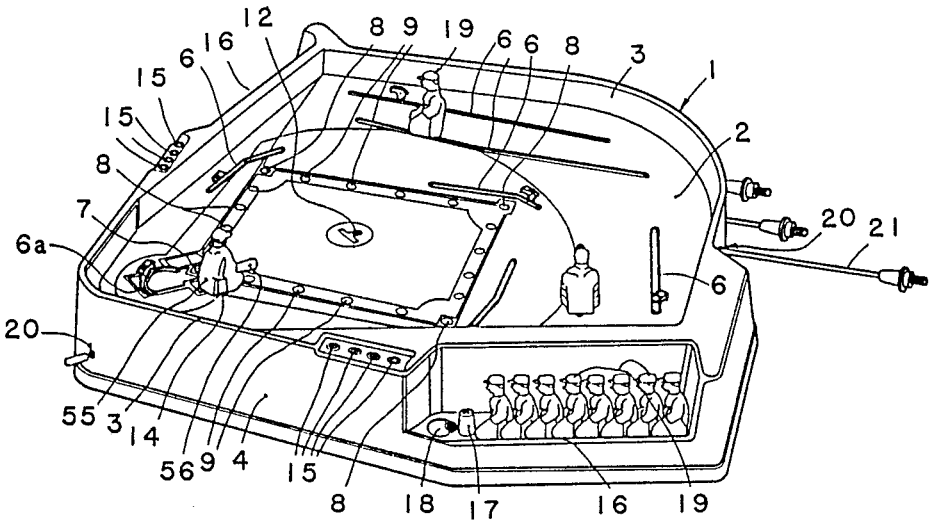
Figure 2:
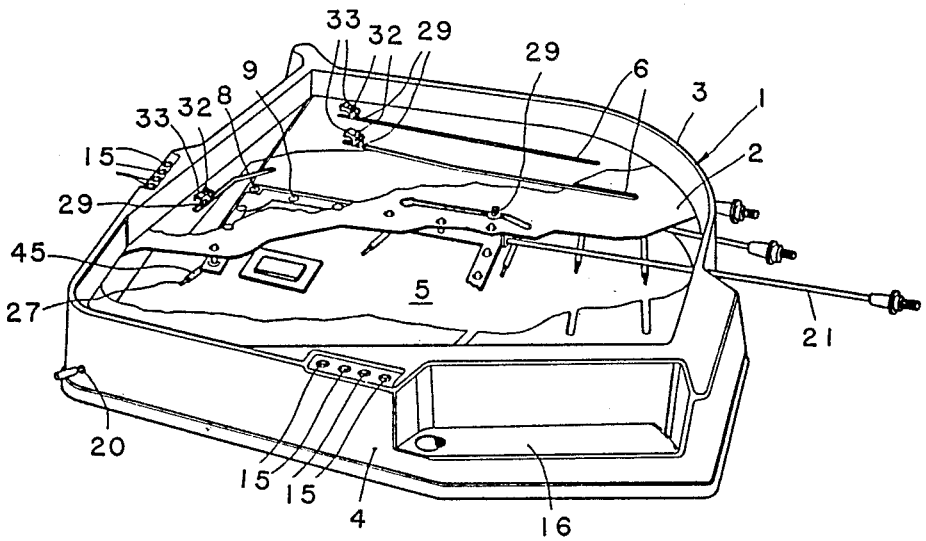
Figure 6:
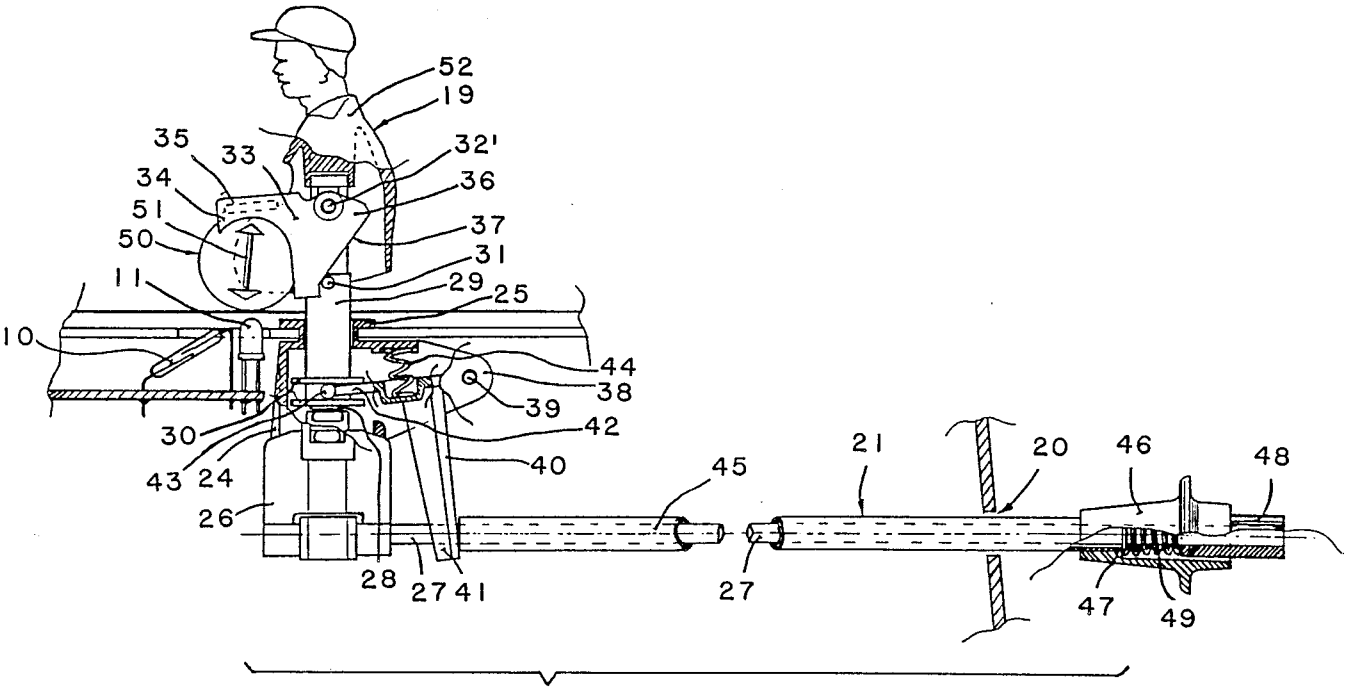
Figure 8:
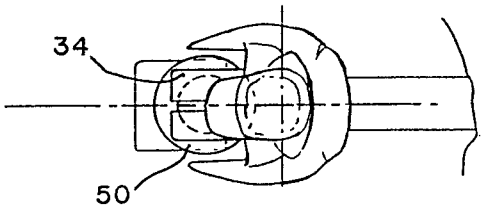
Figure 7:
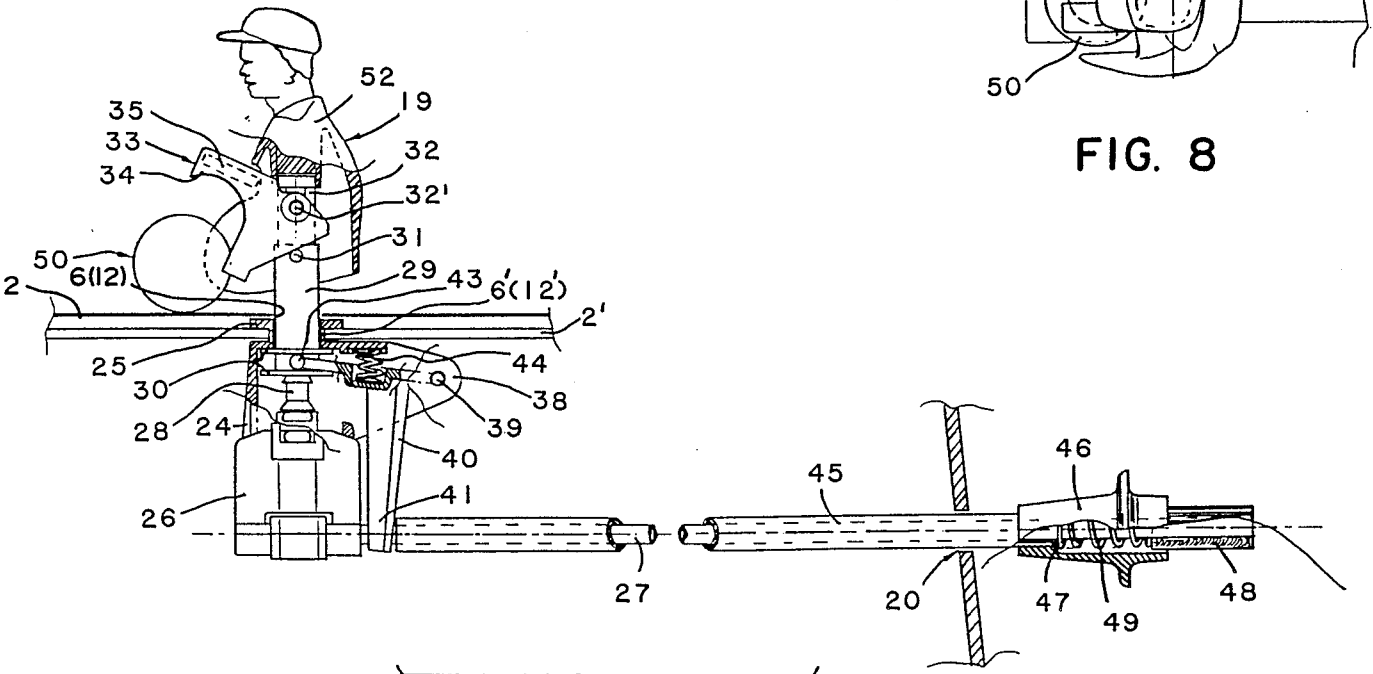
Figure 9:
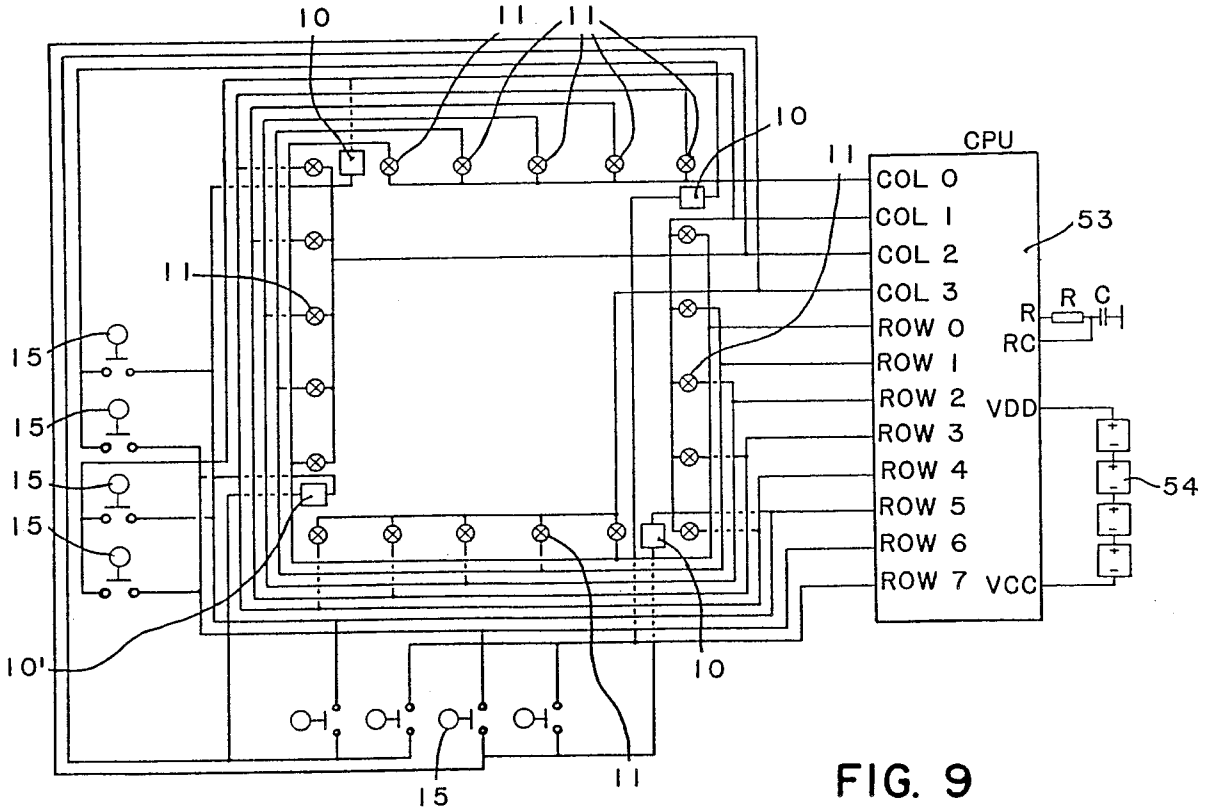

A preferred embodiment of the table game according to this invention will be described below with reference to the accompanying drawings, in which:

FIG. 1 is a perspective top view of the game arranged according to the invention, FIG. 2 is a partial sectional perspective top view of the game, FIG. 3 is a top view of the playing field area of the game with inclined surface portions indicated, FIG. 4 is diagrammatic cross section taken along line A—A of FIG. 3 illustrating the profile of the inclined surface portions, FIG. 5 is a diagrammatic cross section taken along line B—B of FIG. 3, FIG. 6 is a larger scale partial cross section side view of a player figure arrangement with the player in catching position, FIG. 7 is a side view similar to FIG. 6 but with the player in throwing position, FIG. 8 is a top view of the figure of FIGS. 6 and 7, and FIG. 9 is a schematical diagram illustrating the general layout of the electronic system of the game.

As best seen from FIGS. 1 and 2, a table game includes a boxlike substructure 1 preferably made of plastic. The substructure includes a playing surface generally designed 2 and an upwardly extending edging 3 enclosing the surface 2. The outside of the edging 3 forms side walls 4 extending downwardly beyond the level of the playing surface 2 in order to create a free space 5 for purposes mentioned below.

The playing surface 2 presents a number of slots 6 for guiding a player figure each as will be described below.

The playing surface further presents a number of transparent areas, of which one such transparent dot like area 7 indicates the home base and three transparent dot areas 8 indicating the three bases of a baseball field and further a number of transparent dot like areas 9 in rows marking the infield and the paths along which the players run between the bases.

Below each of the transparent base areas 7 and 8 there are arranged a sensor 10 and an indicator means 11, e.g. a light diode or bulb, a liquid crystal display or the like, whereas below the transparent areas 9 only indicator means 11 are arranged, see FIGS. 4, 5 and 6.

On the infield marked by the dot areas 9 there is an opening 12 for a pitcher figure Behind the home base 7 there is a curved slot **6*a* for the catcher figure and at the side of the home base 7 there is a opening 14** for a rotatable batsman.

The playing field surface is properly marked with lines and other markings similar to the lines and markings used for full scale baseball fields and the transparent areas may be colored.

On each side of the home base area 8 there are arranged at the top of the edging 3 adjacent an imagined coach site four push buttons 15 connected to an electronic system described below. At the outside of side walls on each side of the home base corner of the field there are arranged shelf like recesses 16 each having eight pegs 17 and a hole 18 for receiving eight player FIGS. 19 and a ball respectively.

On playing, the player figures of the one team but a batsman are attached to a rotating mechanism in a manner described below whereas of the player figures of the opposite team only one, viz. the batsmans is attached to a rotating mechanism while the other remain at their respective pegs 17.

The idea behind this arrangement is to allow only ten, i.e. nine plus one, players on the playing area and let the remaining ones of the opposite team be symbolized by the push button and electronically operated sensor and indicating arrangement.

The side walls 4 show holes 20 through which control rod arrangements 21 for each of the player figures extend.

As illustrated in FIGS. 3, 4 and 5 the playing surface is divided in inclined or concave areas arranged so that the slots 6, **6*a* and like hole 12 are at the lowest level of each such area. On FIG. 4, at the left hand end, there is a shallow valley 22*a* forming one end of the "valley" area along the left hand slot 6 of FIG. 3, further a wide shallow valley 22*b* around the hole 12 for the pitcher and then three narrow valleys 22*c*, 22*d* and 22*e* along each one of the three right hand slots 6**. By this arrangement a ball ejected outwardly by the batsman figure gradually will lose its speed and roll down towards one of the slots or hole respectively to be catched by the player figure movable along such slot and rotatable in said hole respectively.

The player figures and associated mechanisms are all, but for the batsman figure of the same general design and FIGS. 6, 7 and 8 show the over all design of a figure with rotating and ball catching and ejecting mechanism.

The player FIG. 19 shown on the drawing can be a pitcher figure rotatable in a hole 12 or a player figure adapted to be moved along a slot 6 and rotatable.

A supporting bracket 24 has at its upper end a double flanged ring 25 arranged to engage the edges of a hole 12' or a slot 6' in a stiffening plate 2' attached to the top 2 and the hole 12' and slot 6' are aligned with the hole 12 and/or any slot 6 in the top 2.

The supporting bracket carries an angle transmission housing 26 for an angle drive connecting an incoming rotation control rod 27 and an outgoing axle 28. An axially movable sleeve 29 with a square outer section is received on the outgoing axle 28 and said sleeve has adjacent its lower end two flanges 30 and adjacent its upper end two radially extending pins 31. A radially extending cross shaft 32' is attached to an outgoing sleeve 32 attached to the outgoing axle 28 above the upper end of the sleeve 29 and said cross shaft swingably carries a rocker body generally designated 33 having a pair of forwardly extending arms 34, preferably provided with an intermediate magnetic body 35 and having at a rearwardly extending portion 36 obliquely arranged slide surfaces or edges 37.

The supporting bracket 24 includes extensions 38 carrying a pin 39 for swingably supporting a bell crank lever 40, one bifurcated end 41 of which straddles the rotation control rod 27 and the other likewise bifurcated end 42 of which carries inwardly projecting studs 43 in turn received between the two flanges 30 of the sleeve 29 axially displacable along the outgoing sleeve 32. A spring 44 is interposed between the supporting bracket 24 and said spring is compressed in the rest position shown in FIG. 7.

The rotation control rod 27 is enclosed by a axially movable rigid control tube 45 extending through the hole 20 in the side wall 4 of the game substructure 1. The inner end of the tube 45 abuts the outer face of the bifurcated lever end 41 and the spring 44 biassing the bell crank lever 40 ensures that the lever end is kept engaging the tube when same is moved axially. The control sleeve carries at its outer end a trigger handle 46. Interposed between an annular abutment 47 inside the trigger handle 46 and the end face of an end knob 48 secured to the end of the rod 27 is a further compression spring 49 biassing the handle 46 and control sleeve 45 and bell crank lever 40 in a direction opposite to the acting direction of the above mentioned spring 44.

By pulling the handle 46 and control sleeve 45 outwardly, the bell crank lever is swung rearwardly and downwardly respectively, resulting in a downward pulling of the flanged sleeve 29 and downwardly and inwardly swinging movement of the rocker body 33 allowing a ball 50 to be catched between the arms 35 of said body and held there by the magnet while rotating the player figure and/or moving same figure along its slot. A magnetic body 51 is inserted into the ball 50 and such body ensures a holding between the ball and figure arms and further more ensures an orientation of the ball with the magnetic body in an almost vertical position.

The player figure also includes a torso like body 52 secured to the upper end of the axle 28 with sleeve 32 and rotating with same.

The entire upper portion of the player figure assembly is easily detachable as indicated in FIG. 2, where only the upper end portions of the sleeve 32 and the rocker body 33 are visible.

The electronic system of the game briefly mentioned above and schematically illustrated on FIG. 9 includes the sensors 10, in the preferred embodiment of a type being able to be activated by a magnet 51 inserted into the ball 50, and localized at places where the presence of the ball is to be registered. Other types of sensor devices e.g. optical or electronical sensors could of course be used. Sensors 10 are mounted at each one of the bases and it is to be noted that the sensor 10' at the home base has a double function, namely to sense the presence of the ball at the base and also to control and approve that a pitched ball follows the correct path. The pitch ball thus has to pass straight over the home base. The indicating means 11, preferably light emitting diodes or bulbs are placed below each transparent area and illuminate to illustrate the passage of an imagined player running along the path between the bases and his arrival to each of the bases.

The four push buttons 15 on each side at the coach sites are connected to a micro computer assembly generally designated 53 powered by a battery or the like 54. The micro computer assembly is setable in order to make the operation of the push buttons more or less difficult. The micro computer assembly is also programmed to allow only correct play sequences and give the desired indications on each specific part of the play cycle.

Before starting a play the FIGS. 19 of the one team are attached to the sleeves 32 projecting through the slots 6 and hole 12 while the player FIGS. 19 of the other team are left on the pegs 17 but for the batsman. The batsman 55 differs from the other figures in that he is rotatable only and carries a rigid bat 56, by means of which he is able to hit and eject the ball 50 pushed or thrown toward him by the pitcher figure.

After the offensive player has made the batsman 55 hit the ball 50 he starts pushing the first of his row of buttons 15 until the lights 11 indicate that he, or rather the imagined offensive player, has reached the first base, whereupon he starts pushing the second button and so on. The button pushing proceeds until the defensive player has succeeded in making any of his figures catch the ball and made it bias the sensor 10' of any of the bases or, alternatively, made the figure catching the ball forward it to a player figure better placed for biassing a base sensor with the ball. The next ball is played in the same way and the offensive player now has to push two buttons simultaneously in order to let two players "run" provided either of them has not been hit out.

The table game according to this invention may be played along simplified rules and can also be played according to very complicated rules comparable with real baseball rules.

What I claim and desire to secure by Letters Patent is:

1. A table game of the baseball type including (a) a substructure comprising a board means having a top surface depicting a baseball field, a frame means enclosing said board and forming an edging around the top surface and an outer wall being higher than the edging and enclosing a free space below the board, said board having a number of openings and a number of transparent indication areas and said board top surface further having sections each sloping towards one of said openings, (b) a number of player figure assemblies received in the openings of the board and being movable either along or rotatably in said openings, said figure assemblies being mechanically and remotely controlled by control rod assemblies arranged below the board and accessible at the outside of the outer wall, (c) a number of sensor means attached to the board below the top surface of said adjacent transparent areas, (d) a number of indicating means arranged below the top surface adjacent the transparent areas, (e) two sets of push button means comprising manually operated switches, (f) a computer means having a power source connected to each of said sensor means, said indicating means, and said push button means, (g) and a projectile having means for activating the sensor means, wherein a plurality of openings in the board are circular and allow only rotational movement of the figure assembly received therein, and wherein the remaining openings are slot-like to allow both rotational movements and longitudinal movements of the figure assemblies received therein;

wherein the figure assemblies but for one have ejecting means connected to a trigger means associated with the control rod assemblies, capable of ejecting or pushing the projectile radially away from the figure assembly and the remaining figure has a bat-like striking means capable of projecting said projectile tangentially from said figure assembly;

wherein the sensor means are arranged to sense the presence of the projectile on the board area and the indicating means are capable of illuminating the transparent areas adjacent said board area;

and wherein the computer means is fed data from both the sensor means which in turn is activatable by the manually and mechanically propelled projectile on its passage over the transparent indication areas, and from the push button means on being repeatedly manipulated, a predetermined number of times, said computer means arranged to activate the indicating means on being fed the predetermined data.

2. Table game according to claim 1, wherein each of the player figure assemblies consists of a mechanism unit arranged in the free space adjacent and below the board top surface including an angle drive means connecting a horizontal rotatable control rod the free end of which protrudes outside the game substructure side wall, and a vertical rotatable drive axle carrying an exchangable player's torso and ejecting mechanism, said angle drive means being carried by a support bracket means having guide means arranged to engage complementary guide means at the board for supporting the angle drive means, the end of the control rod connected thereto and the player figures and mechanism attachable to the vertical axle extending therefrom, said mechanism further including a sleeve means axially displacable along the drive axle and a bell crank lever swingably mounted at the support bracket means, one arm of the bell crank lever connected to a rigid control tube means slidably mounted on the control rod and having a trigger means at its outer end; and the other arm of which coupled to a further sleeve axially displacably mounted on the drive axle and having abutment means engaging obliquely arranged slide surfaces of a rocker like body swingably mounted at the end of the drive axle for causing, upon displacing said sleeve upwardly, a projectile engaging portion of said body to swing radially outwardly from said axle; a compression spring means interposed between the outer trigger means carrying end of the control sleeve and an abutment arranged at the rotation control rod end for, on releasing the trigger means, biasing the control sleeve inwardly for swinging the bell crank lever and rocker body projectile engaging portion outwardly from the axle, for ejecting the ball projectile, compression spring means determining the force of the projectile ejection.

3. Table game according to claim 1, wherein the projectile includes at least one magnet integrated into said projectile body and the sensor means are magnetically activatable.

4. Table game according to claim 2 wherein the projectile includes a magnetic means and the projectile engaging portion of the player figure mechanism rocker body projectile engaging portion includes magnetic material causing the projectile to be caught at said projectile engaging portion and wherein the magnetic material is arranged to cause orientation of the projectile magnet in a position facilitating activation of the sensor means.

5. Table game according to claim 1, wherein the computer reacts to signals from the sensor means in a preset way and has adjusting means for determining the required signal type received from the push button means necessary to bring about activation of the indicating means.

6. Table game according to claim 2, wherein a bell crank lever biasing spring is interposed between the support bracket means and the bell crank lever for keeping one end of said lever in engagement with the end of the control tube means, said spring being weaker than the spring associated with the trigger means.

* * * * *